US005634818A

United States Patent [19]

Deng

[11] Patent Number: 5,634,818

[45] Date of Patent: Jun. 3, 1997

[54] PLUG WITH IMPROVED ARRANGEMENT FOR ACCOMMODATING A FUSE

[76] Inventor: C. C. Deng, No. 1 Alley 50, Lane 305, Sec. 3, Chung-Shan Road, Tantze Hsiang, Taichung County, Taiwan

[21] Appl. No.: 586,028

[22] Filed: Jan. 16, 1996

[51] Int. Cl.[6] ..... H01R 13/73

[52] U.S. Cl. ..... 439/622

[58] Field of Search ..... 439/621, 622, 439/696

[56] References Cited

U.S. PATENT DOCUMENTS

| | | | |
|---|---|---|---|
| 4,679,877 | 7/1987 | Ahroni | 439/622 |
| 4,738,639 | 4/1988 | Henderson | 439/622 |
| 4,968,269 | 11/1990 | Urani et al. | 439/621 |

*Primary Examiner*—Gary F. Paumen
*Assistant Examiner*—Christopher Goins
*Attorney, Agent, or Firm*—Morton J. Rosenberg; David I. Klein

[57] ABSTRACT

A plug includes a compartment defined therein, an end face through which first and second blades extend and having an opening defined therein in communication with the compartment, a fuse casing mounted in the compartment for receiving a fuse therein and having an access through which the fuse is passable, a first wire, a second wire in electrical connection with the second blade, a first conductive piece mounted to the fuse casing and in electrical connection with the fuse and the first blade, a second conductive piece mounted to the fuse casing and in electrical connection with the fuse and the first wire, and a lid removably mounted to the end face to cover the opening.

4 Claims, 5 Drawing Sheets

PLUG WITH IMPROVED ARRANGEMENT FOR ACCOMMODATING A FUSE

BACKGROUND OF THE INVENTION

1. Field of the Invention

The present invention relates to an improved plug of the type having a fuse therein and, more particularly, to a plug having an improved arrangement for accommodating a fuse.

2. Description of the Related Art

A typical plug with a fuse therein is shown in FIG. 5 of the drawings and includes a housing 40 having a compartment 41 which is accessible via a lateral side thereof. A first conductive piece 42*a* is mounted to an end portion of a lateral wall which defines the compartment and electrically connected to a first blade 43*a*, while a second conductive piece 42*b* is mounted to the other end portion of the lateral wall and electrically connected to a wire 46*a*. A second blade 43*b* is electrically connected to a second wire 46*b*. A fuse 45 is received in the compartment 41 in which a first conductive end 45*a* thereof is electrically connected to the first conductive piece 42*a* and a second conductive end 45*b* thereof is electrically connected to the second conductive piece 42*b*. A lid 44 is removably mounted to the housing 40 to cover the fuse 45.

A disadvantage of the above-mentioned structure is that the lid 44 is pressed by the user when the user wants to put the plug into a socket (not shown) and thus tends to be damaged easily. In addition, a gap is defined between the lid 44 and the housing 40 such that water may enter the compartment 41 and thus may endanger the user. A further disadvantage of the above-mentioned structure is that the fuse 45 is received in the compartment 41 without any fastening member to assure reliable electrical connection to the conductive pieces 42*a* and 42*b*, resulting in an unstable voltage such that the fuse tends to be damaged easily. Furthermore, a volume of the compartment 41 may be enlarged after a term of use or due to thermal expansion as the housing is generally made of plastic material, which also causes unreliable electrically connection of the fuse to the conductive pieces, thereby aggravating the unstable voltage problem. Another disadvantage of the above-mentioned structure is that the lid tends to be lost and the user has to replace the whole plug as the lid is not sold independently. If the user ignores this, electricity leakage easily occurs and possibly causes injury to children and/or babies.

Therefore, there has been a long and unfulfilled need for an plug to mitigate and/or obviate the above problems.

SUMMARY OF THE INVENTION

It is a primary object of the present invention to provide a plug which includes a compartment defined therein, an end face through which first and second blades extend and having an opening defined therein in communication with the compartment, a fuse casing mounted in the compartment for receiving a fuse therein and having an access through which the fuse is passable, a first wire, a second wire in electrical connection with the second blade, a first conductive piece mounted to the fuse casing and in electrical connection with the fuse and the first blade, a second conductive piece mounted to the fuse casing and in electrical connection with the fuse and the first wire, and a lid removably mounted to the end face to cover the opening.

In accordance with one aspect of the invention, the lid includes an integral wedge with an inclined surface projecting downwardly from a mediate portion of a lateral edge of an underside thereof. The wedge is inserted between the fuse and the fuse casing to position the fuse.

In accordance with a further aspect of the invention, the housing includes a slot defined in each of two opposite lateral sides thereof, and the lid further includes two snap fasteners respectively formed on two ends of the underside thereof and each having a snapping end for being releasably received in the associated slot. The fuse casing and a periphery which defines the opening of the end face together define two spaced first and second side openings therebetween through which the two snap fasteners respectively extend. Preferably, the first and second side openings are of different sizes to provide an indication for properly mounting the lid.

In accordance with another aspect of the invention, the fuse casing includes a first half casing and a second half casing. The first half casing is semi-cylindrical and includes a first recess which is open at a first end thereof and a depression defined in a second end thereof, a pair of protrusions respectively formed on two lateral edges thereof which define the first recess, and spaced first and second notches defined in one of the lateral edges thereof.

The second half casing is semi-cylindrical and includes a second recess which is open at a first end thereof and a hook member defined in a second end thereof for being received in the depression in the first half casing, a pair of cavities respectively defined in two lateral edges thereof which define the second recess for receiving the protrusions of the first half casing, and spaced third and fourth notches defined in one of the lateral edges thereof and aligning with the associated first and second notches for respectively receiving the first and second conductive pieces therein. The open first and second ends of the first and second half casings together define the access of the fuse casing, and the first and second recesses of the first and second half casings together define a chamber for receiving the fuse.

Other objects, advantages, and novel features of the invention will become more apparent from the following detailed description when taken in conjunction with the accompanying drawings.

DESCRIPTION OF THE PREFERRED EMBODIMENT

Figure 1:
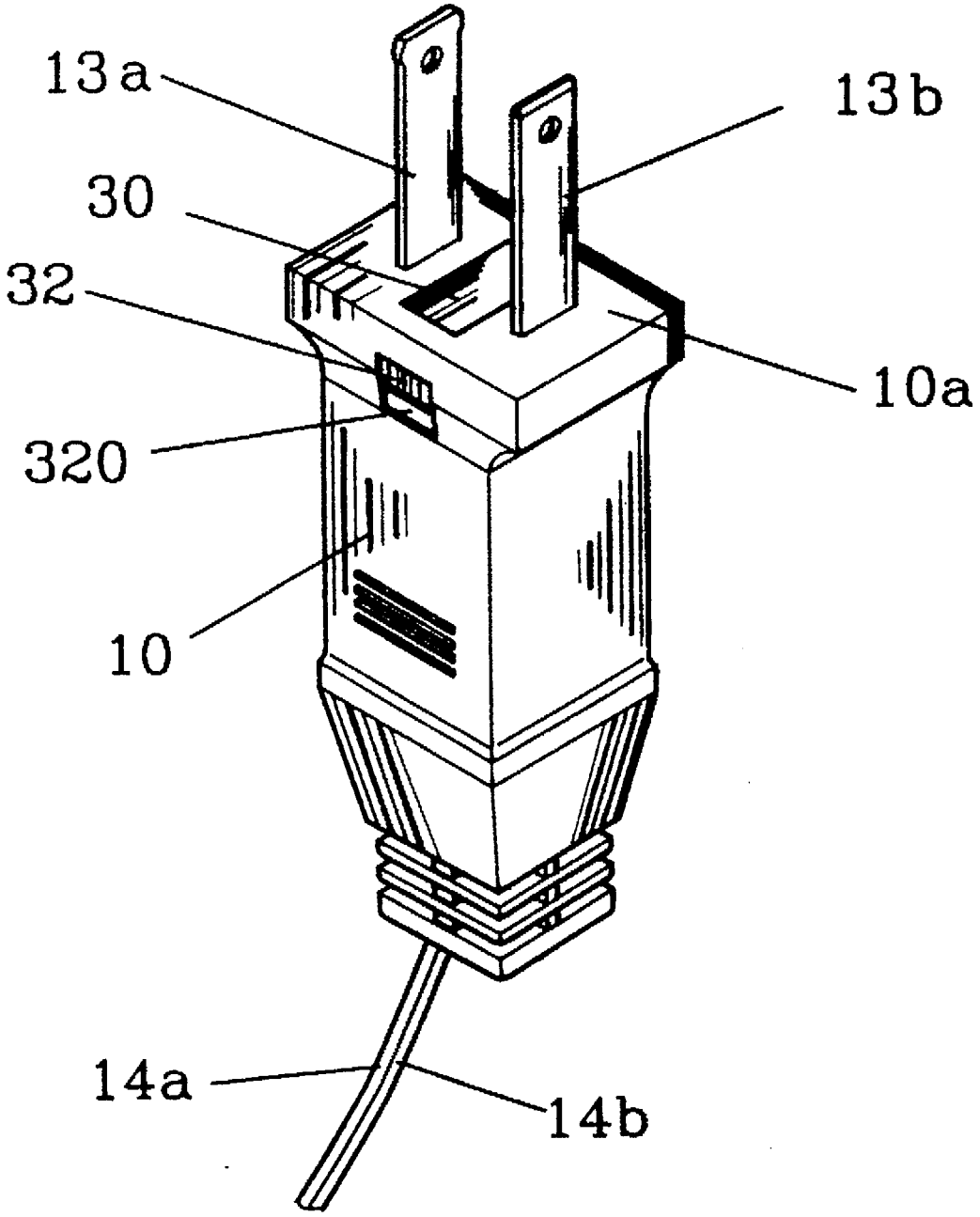
FIG. 1 is a perspective view of a plug with an improved arrangement for accommodating a fuse in accordance with the present invention.
Figure 2:
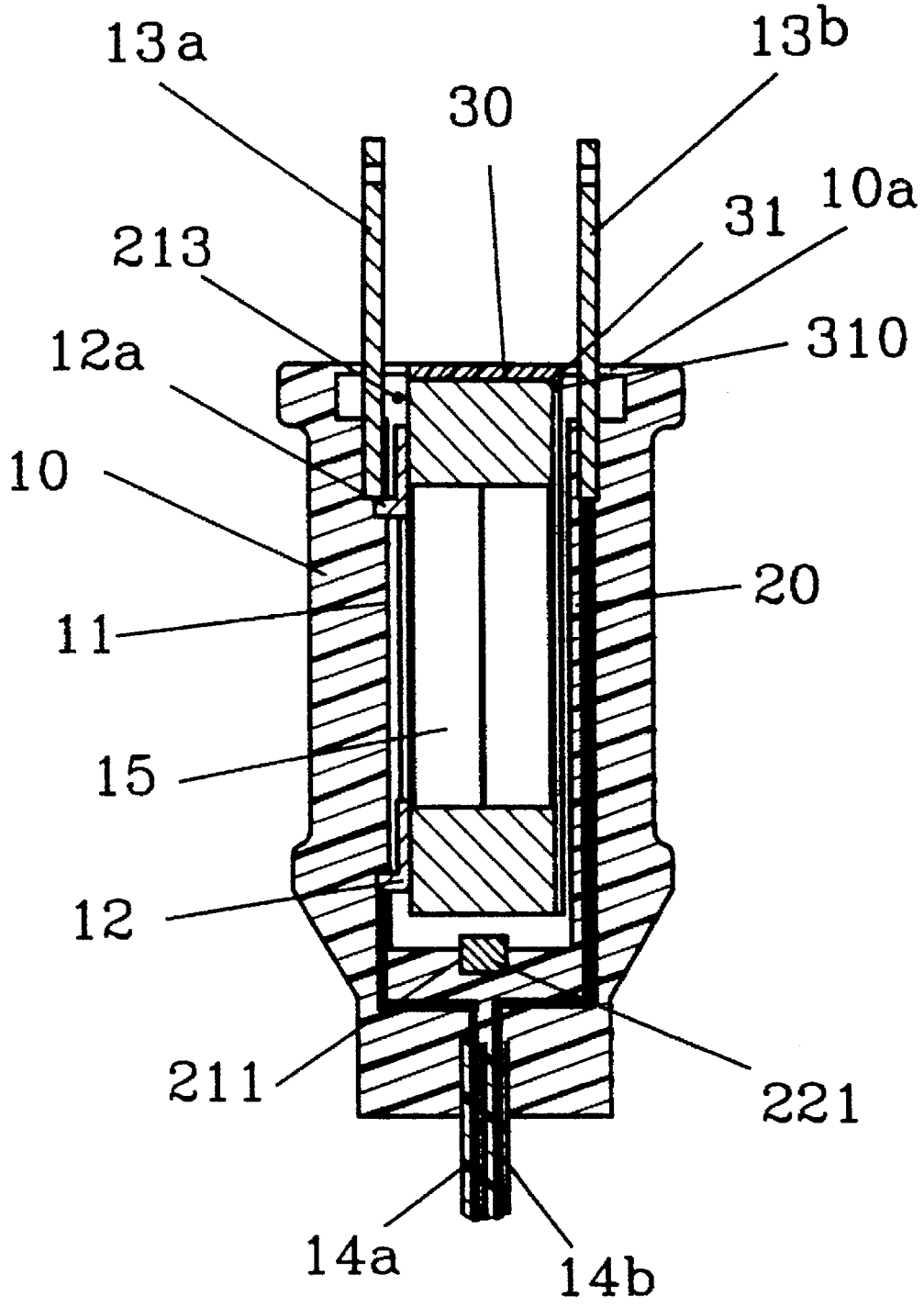
FIG. 2 is a cross-sectional view of the plug in accordance with the present invention.

Referring now to FIGS. 1 to 4 and initially to FIGS. 1 and 2, a plug in accordance with the present invention includes a housing 10 having a compartment 11 defined therein and first and second blades 13*a* and 13*b* extend through an end face 10*a* thereof. A first conductive piece 12*a* is mounted to an upper part (as seen from FIGS. 1 and 2) of a wall defining the compartment 11 and electrically connected to the first blade 13*a*, while a second conductive piece 12*b* is mounted to a lower part of the wall of the compartment 11 and electrically connected to a first wire 14*a*. A second wire 14*b* is electrically connected to the second blade 13*b*.

Figure 3:
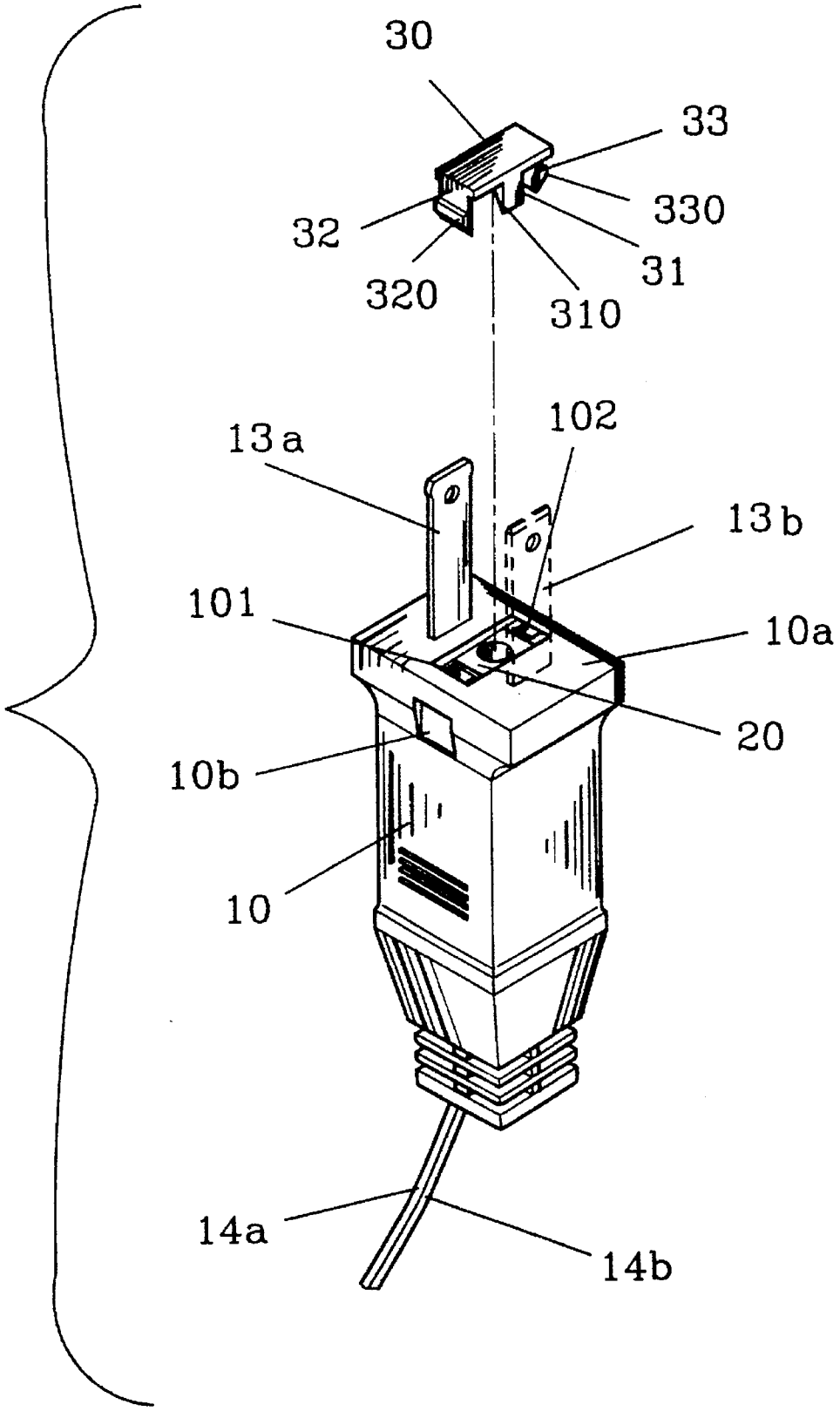
FIG. 3 is a perspective view of the plug with a lid thereof attached for illustration purpose.

A primary feature of the present invention is that a fuse casing 20 is mounted in the compartment 11 for receiving a fuse 15 therein. A first conductive end 15*a* of the fuse 15 is electrically connected to the first conductive piece 12*a* and a second conductive end 15*b* of the fuse 15 is electrically connected to the second conductive piece 12*b*. Referring to FIG. 3, the housing 10 includes an opening (not labeled) defined in the end face 10*a* thereof while the fuse casing 20 is mounted in the compartment 11 in which the fuse casing 20 and a periphery of opening of the end face 10*a* together define spaced first and second side openings 101 and 102 therebetween. A lid 30 is removably mounted to the housing 10. In this embodiment, the lid 30 includes an integral wedge 31 with an inclined surface 310 projecting downwardly from a mediate portion of a lateral edge of an underside thereof. The lid 30 further includes two snap fasteners 32 and 33 respectively formed on two ends of the underside thereof and each having a snapping end 320, 330 for being releasably received in a slot 10*b* defined in each of two opposite lateral sides of the housing 10 (only one slot 10*b* is shown in FIG. 3).

Figure 4:
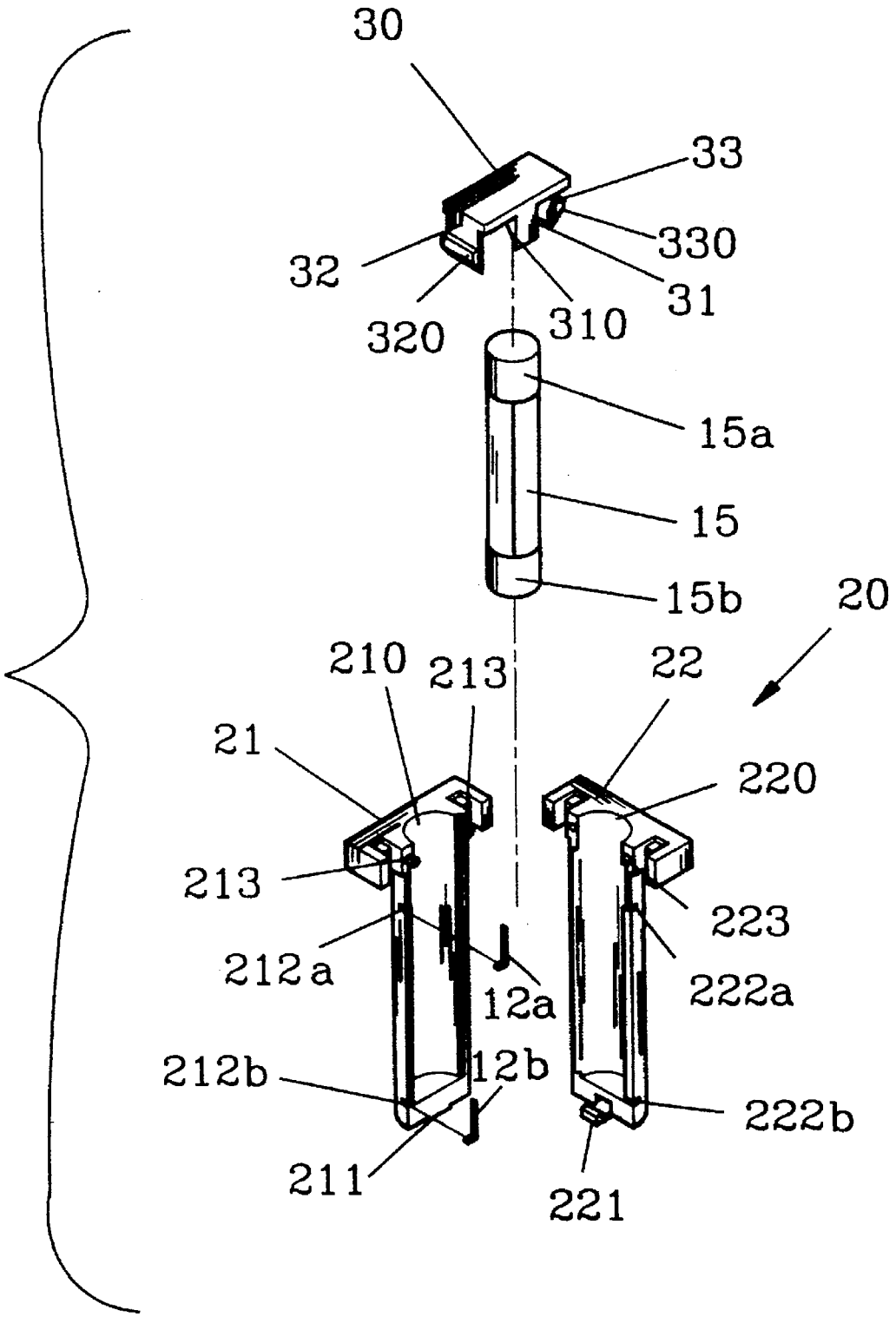
FIG. 4 is an exploded view illustrating a fuse casing and the lid of the plug in accordance with the present invention.
Figure 5:
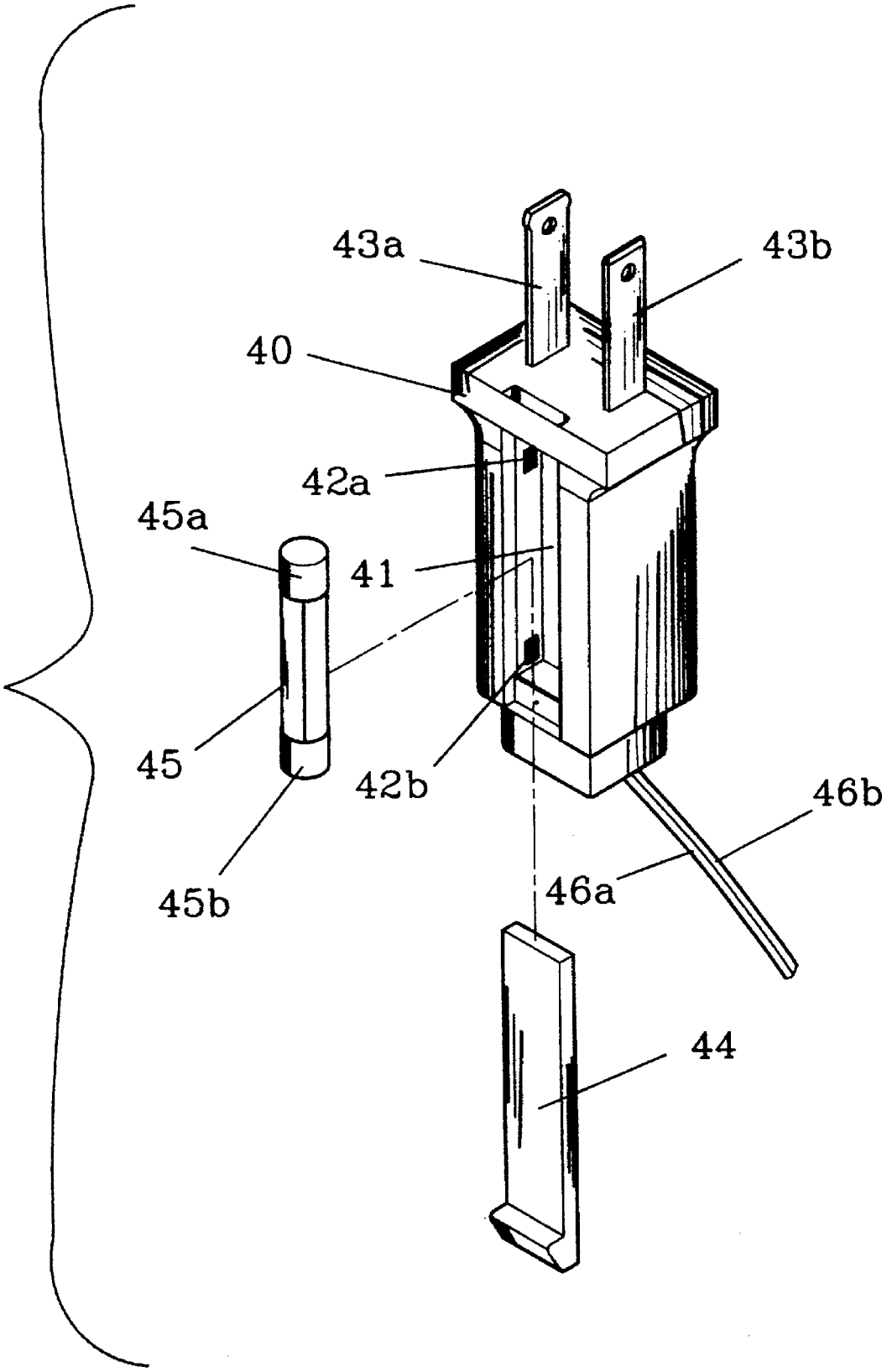
FIG. 5 PRIOR ART
FIG. 5 is an exploded view illustrating a plug according to prior art.

Referring to FIGS. 2 and 4, in this embodiment, the fuse casing 20 includes first and second half casings 21 and 22 which can be assembled together to define a chamber for receiving the fuse 15. As shown in FIG. 4, the first half casing 21 is substantially semi-cylindrical in shape and includes a first recess 210 which is open at a first end thereof and a depression 211 defined in a second end thereof. The first half casing 21 further includes a pair of protrusions 213 respectively formed on two lateral edges thereof which define the first recess 210. In addition, the first half casing 21 includes spaced first and second notches 212*a* and 212*b* defined in one of the lateral edges thereof.

Still referring to FIG. 4, the second half casing 220 is substantially semi-cylindrical in shape and includes a second recess 220 which is open at a first end thereof and a hook member 221 formed on a second end thereof. The second half casing 22 further includes a pair of cavities 223 respectively defined in two lateral edges thereof which define the second recess 220. In addition, the second half casing 22 includes spaced third and fourth notches 222*a* and 222*b* defined in one of the lateral edges thereof.

In manufacturing and assembly, the first and second half casings 21 and 22 are engaged with each other with the hook member 221 of the second half casing 22 received in the depression 211 of the first half casing 21 and with the protrusions 213 of the first half casing 21 received in the cavities 223 of the second half casing 22, thereby forming a cylindrical member defining a chamber therein for receiving the fuse 15. Referring to FIG. 2, the first conductive piece 12*a* is received in the combined first and third notches 212*a* and 222*a*, while the first blade 13*a* is in electrical connection with the first conductive piece 12*a*, as mentioned above. In addition, the second conductive piece 12*b* is received in the combined second and fourth notches 212*b* and 222*b*, while the first wire 14*a* is in electrical connection with the second conductive piece 12*b*, as mentioned above. It is appreciated that the first and second half casings 21 and 22 can be formed by molding injection so as to be integrally formed with the housing 10, while simultaneously defining the above-mentioned side openings 101 and 102 as well as the recesses 210 and 220.

In use, the fuse 15 is inserted into the chamber defined by the recesses 210 and 220 of the first and second half casings 21 and 22 via a common access which is defined after assembly of the first and second casings 21 and 22. The two conductive ends 15*a* and 15*b* of the fuse 15 are respectively electrically connected to the first and second conductive pieces 12*a* and 12*b*. The lid 30 is removably mounted to the housing 10 by respectively extending the two snap fasteners 32 and 33 through the first and second side openings 101 and 102 such that the snapping ends 320 and 330 are received in the associated slots 10*b* defined in the lateral sides of the housing 10. Although not specifically illustrated in the drawings, it is appreciated that the wedge 31 of the lid 30 is inserted into a gap defined between the fuse 15 and fuse casing 20 so as to exert a force onto the fuse 15 to position the fuse 15 such that the fuse 15 is in reliable electrical connection with the conductive pieces 12*a* and 12*b*. It is further appreciated that the first and second side openings 101 and 102 are of different sizes to provide an indication to the user of the proper direction for mounting the lid 30, thereby assuring the reliable electrical connection between the fuse 15 and the conductive pieces 12*a* and 12*b*. Removal of the lid 30 can be achieved by releasing the snap fasteners 32 and 33 from the slots 10*b* for replacement of the fuse 15 by means of a tweezer or the like.

According to the above, it is appreciated that the present invention has the following advantages when compared to the conventional design:

1. The access to the compartment 11 for the fuse 15 is defined in the end face 10*a* of the housing 10 such that the user does not touch the lid 30, and such end face 10*a* contacts and is thus hidden by a wall when the plug is inserted into a socket, which greatly reduces the possibility of electricity leakage and/or inadvertent electric shock.

2. The wedge 31 of the lid 30 provides reliable electrical connection between the fuse 15 and the first and second conductive pieces 12*a* and 12*b*, thereby providing a condition for a stable voltage and reducing the possibility of damage to the fuse 15.

3. The first and second side openings 101 and 102 of the housing 10 are of different sizes to provide an indication to the user the proper direction for mounting the lid 30, thereby further assuring the reliable electrical connection between the fuse 15 and the conductive pieces 12*a* and 12*b*.

Although the invention has been explained in relation to its preferred embodiment, it is to be understood that many other possible modifications and variations can be made without departing from the spirit and scope of the invention as hereinafter claimed.

What is claimed is:

1. A plug comprising:

a housing having a compartment defined therein;

an end face through which first and second blades extend and having an opening defined therein in communication with the compartment;

a fuse casing mounted in the compartment for receiving a fuse therein and having an access through which the fuse is passable, the fuse casing including a first half casing and a second half casing, the first half casing being semi-cylindrical and including a first recess which is open at a first end thereof and a depression defined in a second end thereof, a pair of protrusions being respectively formed on two lateral edges thereof which define the first recess, and spaced first and second notches being defined in one of the lateral edges thereof, the second half casing being semi-cylindrical and including a second recess which is open at a first end thereof and a hook member defined in a second end thereof for being received in the depression in the first half casing, a pair of cavities being respectively defined in two lateral edges thereof which define the second recess for receiving the protrusions of the first half casing, and spaced third and fourth notches being defined in one of the lateral edges thereof and aligning with the associated first and second notches for respectively receiving the first and second conductive pieces therein, wherein the open first and second ends of the first and second half casings together define the access of the fuse casing, and wherein the first and second recesses of the first and second half casings together define a chamber for receiving the fuse;

a first wire;

a second wire which is in electrical connection with the second blade;

a first conductive piece mounted to the fuse casing and in electrical connection with the fuse and the first blade;

a second conductive piece mounted to the fuse casing an in electrical connection with the fuse and the first wire; and a lid removably mounted to the end face to cover the opening.

2. The plug as claimed in claim 1, wherein the lid includes a wedge with an inclined surface projecting downwardly from a mediate portion of a lateral edge of an underside thereof, the wedge is inserted between the fuse and the fuse casing to position the fuse.

3. The plug as claimed in claim 2, wherein:

the housing includes a slot defined in each of two opposite lateral sides thereof, and the lid further includes two snap fasteners respectively fasteners formed on two ends of the underside thereof and each having a snapping end for being releasably received in the associated slot, the fuse casing and a periphery which defines the opening of the end face together defining two spaced first and second side openings therebetween through which the two snap fasteners respectively extend.

4. The plug as claimed in claim 3, wherein the first and second side openings are of different sizes.

* * * * *